US010781505B2

(12) United States Patent
Nikolic et al.

(10) Patent No.: US 10,781,505 B2
(45) Date of Patent: Sep. 22, 2020

(54) METHOD FOR TREATING COPPER CONCENTRATES

(71) Applicants: Glencore Technology Pty Ltd, Brisbane (AU); Commonwealth Scientific and Industrial Research Organisation, Campbell (AU)

(72) Inventors: Stanko Nikolic, Brisbane (AU); Chunlin Chen, Brisbane (AU); Shafi Jahanshahi, Brisbane (AU)

(73) Assignees: Glencore Technology Pty Ltd, Brisbane (AU); Commonwealth Scientific and Industrial Research Organisation, Campbell (AU)

( * ) Notice: Subject to any disclaimer, the term of this patent is extended or adjusted under 35 U.S.C. 154(b) by 149 days.

(21) Appl. No.: 15/735,278

(22) PCT Filed: Jun. 10, 2016

(86) PCT No.: PCT/AU2016/050473
§ 371 (c)(1),
(2) Date: Dec. 11, 2017

(87) PCT Pub. No.: WO2016/197201
PCT Pub. Date: Dec. 15, 2016

(65) Prior Publication Data

US 2018/0171433 A1 Jun. 21, 2018

(30) Foreign Application Priority Data

Jun. 12, 2015 (AU) ..... 2015902212

(51) Int. Cl.
*C22B 15/00* (2006.01)
*C22B 15/06* (2006.01)

(52) U.S. Cl.
CPC ..... *C22B 15/0054* (2013.01); *C22B 15/0041* (2013.01)

(58) Field of Classification Search
CPC ..... C22B 15/0041; C22B 15/0054
See application file for complete search history.

(56) References Cited

U.S. PATENT DOCUMENTS 4,308,058 A * 12/1981 Makipirtti ..... C22B 13/02 75/629
4,521,245 A * 6/1985 Yarygin ..... C22B 5/14 75/586

(Continued)

FOREIGN PATENT DOCUMENTS

RU 2359046 C1 * 6/2009
WO WO-2005098059 A1 10/2005

OTHER PUBLICATIONS

RU 2359046 C1 English abstract (Year: 2009).*

(Continued)

*Primary Examiner* — Tima M. McGuthry-Banks
(74) *Attorney, Agent, or Firm* — Shackelford, Bowen, McKinley & Norton, LLP

(57) ABSTRACT

A method for the pyrometallurgical processing of a sulphide material containing copper, the sulphide containing relatively high quantities of silica and relatively low quantities of iron, wherein the process comprises feeding the sulphide material to a TSL furnace operated under oxidising conditions such that the sulphide material forms blister copper containing between 1.2 and 1.5 wt % sulphur and a slag containing between 7 and 13 wt % copper.

13 Claims, 1 Drawing Sheet

(56) References Cited

U.S. PATENT DOCUMENTS

| | | | | |
|---|---|---|---|---|
| 5,888,270 | A | 3/1999 | Edwards et al. | |
| 6,761,749 | B1 | 7/2004 | Poijarvi et al. | |
| 7,749,301 | B2 * | 7/2010 | Hughes | C22B 15/0054 75/643 |

OTHER PUBLICATIONS

RU 2359046 machine translation, partial (Year: 2009).*
Fedorova, N. A. et al. "Distribution of Copper, Nickel, Cobalt, and Iron between Products of Smelting of Copper Concentrate Obtained by Flotation of Converter Matte." Russian Journal of Applied Chemistry vol. 76, No. 2, pp. 175-179. (Year: 2003).*
Pigarev, S. P. et al. "Structure and Properties of the Slags of Continuous Converting of Copper Nickel-Containing Mattes and Concentrates: IV. Influence of the Slag Temperature and Composition on the Slag Melt Viscosity." Russian Metallurgy vol. 2013 No. 3 pp. 176-181 (Year: 2013).*
RU 2359046 C1 human translation (Year: 2009).*
Mathe, Vijaya, "International Search Report," prepared for PCT/AU2016/050473, dated Aug. 5, 2016, five pages.

* cited by examiner

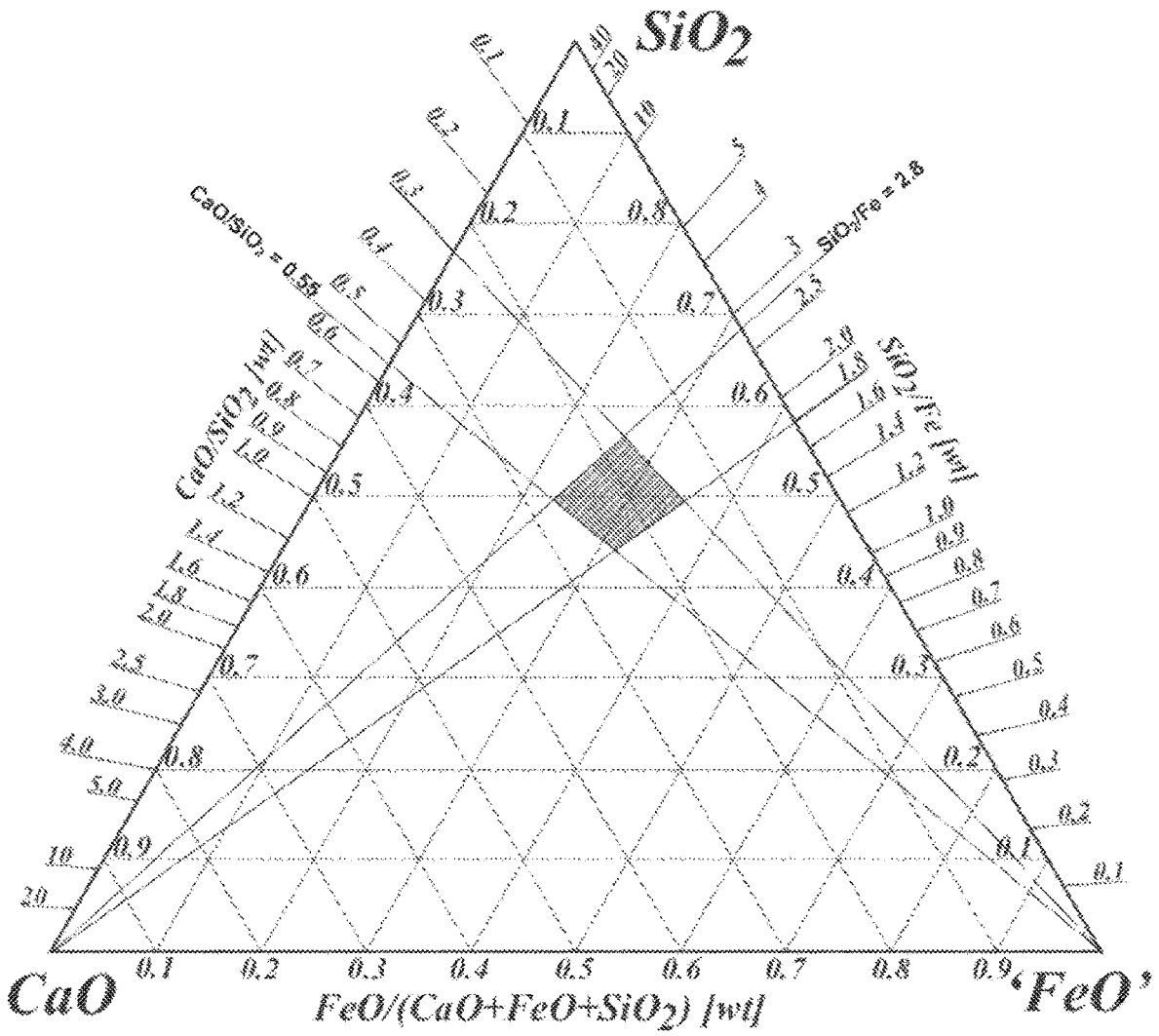
SiO2
CaO
'FeO'
CaO/SiO2 = 0.55
SiO2/Fe = 2.8
CaO/SiO2 [wt]
SiO2/Fe [wt]
FeO/(CaO+FeO+SiO2) [wt]

METHOD FOR TREATING COPPER CONCENTRATES

TECHNICAL FIELD

The present invention relates to a method for treating copper concentrates. In particular, the present invention relates to a method for the pyrometallurgical treatment of copper concentrates in a top submerged lance (TSL) furnace.

BACKGROUND ART

In many primary copper smelting processes, and particularly primary copper smelting processes in a TSL furnace (such as the ISASMELT™ process), iron is an essential input. In these processes, a copper iron sulphide matte and an iron silicate slag are typically produced, and the processes are suitable for copper concentrates where chalcopyrite is the predominant copper mineral.

There are numerous ore deposits around the world (such as in Zambia, the Democratic Republic of Congo, Kazakhstan and Australia) where the copper concentrate produced by froth flotation contains relatively large quantities of silica and relatively low quantities of iron. These concentrates are unsuitable for primary copper smelting, but can be smelted in direct-to-blister (DtB) processes using the silica present in the concentrate as a fluxing agent.

However, the low levels of iron and high levels of silica in these concentrates that make them unsuitable for primary copper smelting also make DtB smelting difficult, as high furnace temperatures are required in order to melt the slag.

Thus, there would be an advantage if it were possible to provide a pyrometallurgical process for the treatment of high-silica, low-iron copper sulphide concentrate to produce blister copper.

It will be clearly understood that, if a prior art publication is referred to herein, this reference does not constitute an admission that the publication forms part of the common general knowledge in the art in Australia or in any other country.

SUMMARY OF INVENTION

The present invention is directed to a method for the pyrometallurgical processing of sulphide material containing copper, which may at least partially overcome at least one of the abovementioned disadvantages or provide the consumer with a useful or commercial choice.

With the foregoing in view, the present invention in one form, resides broadly in a method for the pyrometallurgical processing of a sulphide material containing copper, the sulphide containing relatively high quantities of silica and relatively low quantities of iron, wherein the process comprises feeding the sulphide material to a TSL furnace operated under such conditions that the sulphide material forms blister copper containing up to 2 wt % sulphur and a slag containing up to 15 wt % copper.

In another aspect, the invention resides broadly in a method for the pyrometallurgical processing of a sulphide material containing copper, the sulphide containing relatively high quantities of silica and relatively low quantities of iron, wherein the process comprises feeding the sulphide material to a TSL furnace operated under such conditions that the sulphide material forms blister copper and a slag having a $CaO/SiO_2$ ratio of between 0.30 and 0.55 by weight and an $SiO_2/Fe$ ratio of between 1.8 and 2.8 by weight.

The sulphide material may be obtained from any suitable source. It is envisaged, however, that the sulphide material may be a froth flotation concentrate. In particular, it is envisaged that the sulphide material may be a froth flotation concentrate produced from the treatment of copper ore in which chalcopyrite is not the principal copper mineral. Thus, in a preferred embodiment of the invention, the sulphide material may contain more than about 20 wt % copper. More preferably, the sulphide material may contain more than about 25 wt % copper. Even more preferably, the sulphide material may contain more than about 30 wt % copper.

Preferably, the sulphide material contains between about 10 wt % and 40 wt % silica. More preferably, the sulphide material contains between about 15 wt % and 35 wt % silica. Even more preferably, the sulphide material contains between about 20 wt % and 30 wt % silica.

Preferably, the sulphide material contains less than approximately 20 wt % iron. More preferably, the sulphide material contains less than about 15 wt % iron. Even more preferably, the sulphide material contains less than about 12 wt % iron.

As previously stated, the sulphide material is fed to a TSL furnace. It is envisaged that, when the sulphide material is fed to the TSL furnace, the furnace may contain a bath of molten material therein. Preferably, at least a portion of the molten material in the TSL furnace comprises slag.

It will be understood that the TSL furnace includes one or more top entry lances, the lower ends of which are submerged within the bath of molten material during the operation of the method of the present invention.

Any suitable TSL furnace may be used, such as, but not limited to, furnaces sold under the trademarks ISASMELT™. A skilled addressee will be familiar with the construction of TSL furnaces, and no further discussion of the construction of the furnace is required.

The TSL furnace may be operated at any suitable temperature. Preferably, however, the TSL furnace may be operated at a temperature at which the formation of liquid slag and blister copper occurs. In a preferred embodiment of the invention, the TSL furnace may be operated so that the bath temperature within the furnace is within the range of from 1100° C. to 1450° C. More preferably, the TSL furnace may be operated so that the bath temperature within the furnace is within the range of from 1150° C. to 1400° C. Still more preferably, the TSL furnace may be operated so that the bath temperature within the furnace is within the range of from 1180° C. to 1380° C. Most preferably, the TSL furnace may be operated so that the bath temperature within the furnace is within the range of from 1200° C. to 1350° C.

In some embodiments of the invention, one or more temperature modifying substances adapted to assist in achieving the desired bath temperature may be added to the furnace. Any suitable temperature modifying substances may be added, although it is envisaged that the temperature modifying substances may comprise fuels such as, but not limited to, diesel, natural gas, fuel oil, coal, coke, petroleum coke or the like, or any suitable combination thereof.

In a preferred embodiment of the invention, the TSL furnace is operated under oxidising conditions. It is envisaged that the oxidising conditions within the furnace may be created through the addition of an oxygen-containing gas into the furnace. Preferably, the oxygen-containing gas may be introduced to the furnace through the lance. Any suitable oxygen containing gas may be used, such as air, oxygen-enriched air, or oxygen.

Preferably, the TSL furnace is operated under conditions wherein the slag that is produced corresponds to a low melting temperature area of the $CaO—SiO_2—FeO_x$ phase diagram. In this embodiment, it is envisaged that the TSL furnace may be operated under conditions where the slag composition that is produced is at or close to the trydimite saturation point at which the activity of iron is relatively low. In this embodiments of the invention (and particularly when the slag contains relatively low quantities of oxides such as $Al_2O_3$ or MgO), it is envisaged that the TSL furnace may be operated under such conditions of temperature and oxidation that the ratio of $CaO/SiO_2$ in the slag is between 0.30 and 0.55. More preferably, the TSL furnace may be operated under such conditions of temperature and oxidation that the ratio of $CaO/SiO_2$ in the slag is between 0.35 and 0.50. Still more preferably, the TSL furnace may be operated under such conditions of temperature and oxidation that the ratio of $CaO/SiO_2$ in the slag is between 0.40 and 0.45.

In some embodiments (and particularly when the slag contains relatively low quantities of oxides such as $Al_2O_3$ or MgO), it is envisaged that the TSL furnace may be operated under such conditions of temperature and oxidation that the ratio of $SiO_2$/Fe in the slag is between 1.8 and 2.8. More preferably, the TSL furnace may be operated under such conditions of temperature and oxidation that the ratio of $SiO_2$/Fe in the slag is between 2.0 and 2.6. Still more preferably, the TSL furnace may be operated under such conditions of temperature and oxidation that the ratio of $SiO_2$/Fe in the slag is between 2.2 and 2.4.

Preferably, the TSL furnace may be operated under such conditions of temperature and oxidation that the composition of the slag in the furnace falls substantially within the shaded area of the ternary phase diagram illustrated in FIG. 1.

In some embodiments of the invention, one or more slag chemistry modifying substances may be added to the furnace. Any suitable slag chemistry modifying substances may be added, although it is envisaged that the slag chemistry modifying substances may assist in achieving the desired ratios of $CaO/SiO_2$ and $SiO_2$/Fe in the slag. Preferably, the slag chemistry modifying substances comprise substances containing calcium. Any suitable calcium-containing substances may be used, such as, but not limited to, lime, limestone, dolomite or the like, or any suitable combination thereof.

As previously stated, the blister copper formed by the method of the present invention may contain up to 2 wt % sulphur. More preferably, the blister copper formed by the method of the present invention may contain up to 1.8 wt % sulphur. Yet more preferably, the blister copper formed by the method of the present invention may contain up to 1.6 wt % sulphur. Most preferably, the blister copper formed by the method of the present invention may contain no more than 1.53 wt % sulphur.

As previously stated, the slag formed by the method of the present invention may contain up to 15 wt % copper. More preferably, the slag formed by the method of the present invention may contain up to 13.5 wt % copper. Even more preferably, the slag formed by the method of the present invention may contain up to 13 wt % copper. Most preferably, the slag formed by the method of the present invention contains between about 7 wt % copper and about 13 wt % copper.

It is envisaged that sulphur dioxide may also be produced in the method of the present invention. Typically, the sulphur dioxide produced by the present invention will be in a gaseous state.

The present invention provides numerous advantages over the prior art. Firstly, the fuel requirements for the method are minimised by taking advantage of the heat generated during the combustion of the iron and sulphur within the bath of molten slag.

In addition, the present invention eliminates the need for blending of concentrates prior to smelting, as well as eliminating the need for the addition of iron fluxes to produce conventional slags. Further, the present invention allows for the direct production of blister copper, and produces only a single sulphur dioxide-rich gas source to be removed from the smelter, thereby reducing the costs of smelter design and construction.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 1 illustrates a ternary phase diagram of the CaO—SiO2—FeOx system.

EXAMPLES

Pilot Plant Trials

A suitable sulphide copper concentrate from a local mine was subjected to smelting trial. The pilot plant trials were conducted in a pilot plant size ISASMELT™ furnace. The furnace consists of a cylindrical furnace with an internal diameter of approximately 305 mm and a height of approximately 1.8 m. The vessel is lined with chrome-magnesite refractory bricks, followed by high alumina bricks and a kaowool lining to the shell. A mass flow control is used to inject natural gas, and air into the bath via a 29 mm inner diameter stainless steel lance. The solid material fed to the furnace is added in known amounts to a calibrated variable speed conveyor belt which drops the feed onto a vibrating feeder and then through a chute at the top of the furnace. Removal of molten products from the furnace can be achieved by opening the single taphole at the base of the furnace and collecting the materials in cast iron ladles. If necessary, the furnace can be tilted around its central axis to completely drain the furnace of its contents. The process off-gases pass through a drop-out box and an evaporative gas cooler, before being directed through a baghouse and a caustic soda scrubber, for removal of any dust and sulphur-containing gases, prior to venting to the stack. Bath temperature is measured continuously via a thermocouple, placed through the refractory lining of the furnace. Independent confirmation of the bath temperature is obtained using an optical pyrometer, a dip-tip measurement during tapping or a dip-tip measurement of the slag through the top of the furnace. The pilot furnace is initially heated and then held at temperature between tests by means of a gas burner located in the taphole.

Tables 1-5 show the feed materials provided for the pilot test work and the chemical composition of the feed materials.

TABLE 1

| Composition of the Copper Concentrate used in the smelting tests (wt %) | | | | | | | | | | | | |
|---|---|---|---|---|---|---|---|---|---|---|---|---|
| Sample ID | Cu | Fe | S | Si | Al | As | Mg | Pb | Zn | Ca | K | Na |
| Concentrate | 33.6 | 11.2 | 17.4 | 11.0 | 2.89 | 0.43 | 0.51 | 0.06 | 0.22 | 0.56 | 1.45 | 0.65 |

Limestone, sourced from Glencore's Mount Isa Mines operation, was used as the flux for these trials. The composition of the limestone flux is shown in Table 2.

TABLE 2

| Composition Limestone Flux used in the smelting tests (wt %) | | | | |
|---|---|---|---|---|
| Sample ID | CaCO3 | Al2O3 | Fe2O3 | SiO2 |
| Limestone | 93.7 | 0.80 | 1.10 | 4.40 |

Silica, sourced from a local quarry wholesaler, was used as a trim flux and to create the pseudo concentrate. The composition of the silica is shown in Table 3.

TABLE 3

| Composition of Silica Flux used in the smelting tests (wt %) | | | | |
|---|---|---|---|---|
| Sample ID | SiO2 | Al2O3 | Fe2O3 | FeSO4 |
| Silica Flux | 97.95 | 1.29 | 0.56 | 0.20 |

Coal, used as a supplementary lump fuel during one of the tests, has an analysis shown in Table 4.

TABLE 4

| Composition of Silica Flux used in the smelting tests (wt %) | | | | | |
|---|---|---|---|---|---|
| Sample ID | Moisture | Ash | Volatiles | Fixed Carbon | Sulfur |
| Lump Coal | 1.0 | 11.9 | 33.8 | 51.6 | 1.7 |

Additional to the traditional fluxes the feed was also doped with cobalt so that the distribution of cobalt could be determined during this testwork. The doping agent select for use in this testwork was Cobalt Carbonate, sourced from a local ceramics supplier. The composition of the cobalt is shown in Table 5. To be able to make sure that the fine Cobalt Carbonate did not carry-over to the off-gas stream it had to be mixed up with an equal portion of water and 5% of lingo-sulphate binder.

TABLE 5

| Composition of Cobalt Flux (wt %) | | |
|---|---|---|
| Sample ID | CoCO3 | SiO2 |
| Lump Coal | 90 | 10 |

During the smelting of the feed materials in an ISASMELT™ furnace, oxygen from the lance air is required to burn the sulphide copper concentrate to produce $SO_2$ gas, blister copper and slag.

A total of 4 separate tests were completed which ranged from 1 hour to 3 hours in duration. In general 10 kg batches of the mixed feed, previously weighed in buckets, were distributed over 1 metre lengths of the feed conveyor, and the speed of the conveyor was adjusted to give the desired feed rate (typically 45-50 kg/h of wet feed). Additions of limestone flux were weighed out and distributed similarly at a fixed addition rate over each 1 metre length of the conveyor. Silica flux and cobalt flux were also added in the same manner, for the purpose of simulating the high-silica and high-cobalt concentrates that are commercially available and suitable for DtB smelting.

The lance tip was then submerged in the slag bath, the feed to the furnace started and the lance flows changed to those required for the smelting of the feed mix.

The temperature of the slag bath was monitored by means of a thermocouple contained in a sheath in contact with the slag bath. The bath temperature was controlled by means of adjustments to the natural gas flow rate and/or the variation in the oxygen enrichment of the lance air.

Samples of the slag for assay purposes were taken at intervals by means of a dip bar lowered to the base of the furnace. The thickness of the slag frozen on the bar gave a good indication of the degree of fluidity of the molten slag. The temperature of the slag could be measured by raising the lance and inserting a temperature probe into the furnace so that it contacted the slag.

At the completion of a smelting test, the feed and was stopped and the lance raised out of the slag bath. The blister copper and slag were then tapped out of the furnace by opening the tap hole with a combination of drill and oxy-lance. Spoon samples of the blister copper and slag were taken plus a sample of the molten slag was granulated by slowly pouring the molten slag into water.

A description of the individual test conditions, including furnace inputs and outputs, bath temperatures (as shown by furnace thermocouple) etc. is given in Table 6.

TABLE 6

| Summary of Results | | | | | | | | | | | |
|---|---|---|---|---|---|---|---|---|---|---|---|
| | Starting | Feed | | | | Silica | Cobalt | | | Nat | |
| Test No. | Bath kg | Feed type | Dry kg/h | Total kg | Limestone kg | flux kg | flux kg | Air Nm3 | Oxygen Nm3 | Gas Nm3 | Coal kg |
| 6 | 50 | N Parkes Concentrate | 45 | 93.6 | 23.39 | 11.23 | — | 138.9 | 18.64 | 16.05 | — |
| 7 | 50 | N Parkes Concentrate | 50 | 150 | 37.50 | 18.00 | 2.84 | 188.1 | 40.07 | 26.78 | — |

TABLE 6-continued

| Summary of Results | | | | | | | | | | | |
|---|---|---|---|---|---|---|---|---|---|---|---|
| 8 | 50 | N Parkes Concentrate | 50 | 130 | 32.50 | 15.60 | 2.46 | 147.5 | 40.96 | 24.59 | — |
| 9 | 50 | N Parkes Concentrate | 50 | 140 | 35.00 | 16.80 | 2.65 | 161.8 | 44.50 | 20.36 | 8.40 |

| | | Final Slag | | | | | Blister Copper | |
|---|---|---|---|---|---|---|---|---|
| Test No. | Temp ° C. | % Co | % Cu | $CaO/SiO_2$ Ratio | $SiO_2/Fe$ Ratio | kg | % S | kg |
| 6 | 1229 | 0.02 | 12.52 | 0.42 | 2.29 | 136.3 | 1.21 | 14.2 |
| 7 | 1261 | 0.65 | 7.93 | 0.44 | 2.41 | 160.4 | 1.53 | 30.0 |
| 8 | 1280 | 0.66 | 8.11 | 0.43 | 2.43 | 162.6 | 1.24 | 24.1 |
| 9 | 1282 | 0.83 | 8.30 | 0.41 | 2.57 | 185.0 | 1.22 | 17.0 |

The pilot plant work set out above demonstrates that by controlled oxidation of the copper concentrate, the furnace can reliably produce blister copper with a sulphur content of 1.2-1.5 wt % S, in equilibrium with a slag containing 7-13 wt % Cu. Cobalt reports to the slag under these conditions.

Surprisingly, the pilot plant experimental work also showed that when the invention was conducted in a top entry lance furnace, uncontrollable foaming of the bath did not occur. The present inventors were of the view that uncontrollable foaming was a likely outcome of the process of the present invention prior to conducting the pilot plant work. It will be understood by those skilled in the art that the oxidation state of iron in equilibrium with blister copper is known to have a strong predisposition to forming magnetite within the slag, saturating the slag and creating ideal conditions for slag foam to occur, when blowing air into a bath of molten slag. However, the pilot plant work demonstrated that either no foaming occurred or that a stable foam was generated. The choice of slag composition is therefore appropriate for the task.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A method for the pyrometallurgical processing of a sulphide material containing copper, the sulphide containing between about 10 wt % and 40 wt % silica and less than approximately 20 wt % iron, the method comprising feeding the sulphide material to a top submerged lance furnace operated under such conditions that the sulphide material forms blister copper and a slag having a $CaO/SiO_2$ ratio of between 0.30 and 0.55 by weight and an $SiO_2/Fe$ ratio of between 1.8 and 2.8 by weight.

2. The method according to claim 1 wherein the sulphide material is a froth flotation concentrate.

3. The method according to claim 1 wherein the sulphide material contains more than about 20 wt % copper.

4. The method according to claim 1 wherein the top submerged lance furnace contains a bath of molten material therein, at least a portion of the molten material comprising the slag.

5. The method according to claim 4 wherein the top submerged lance furnace includes one or more top entry lances, and wherein a lower end of each of the one of more top entry lances is submerged within the bath of molten material during operation.

6. The method according to claim 4 wherein the top submerged lance furnace is operated such that the temperature of the bath of molten material is within a range of from 1100° C. to 1450° C.

7. The method according to claim 6 wherein one or more temperature modifying substances adapted to assist in achieving a desired bath temperature are added to the top submerged lance furnace.

8. The method according to claim 4 wherein the top submerged lance furnace is operated such that the composition of the slag corresponds to a low melting temperature area of a $CaO—SiO_2—FeO_x$ phase diagram.

9. The method according to claim 8 wherein the composition of the slag is at or close to a trydimite saturation point.

10. The method according to claim 1 wherein the TSL furnace is operated under oxidizing conditions.

11. The method according to claim 1 wherein at least one slag chemistry modifying substances are added to the TSL furnace.

12. The method according to claim 1 wherein the blister copper contains up to 1.6 wt % sulphur.

13. The method according to claim 1 wherein the slag contains between about 7 wt % and 13 wt % copper.

* * * * *